United States Patent [19]

Peyre

[11] Patent Number: 4,671,153

[45] Date of Patent: Jun. 9, 1987

[54] TAPE LOADING AND POSITIONING DEVICE

[75] Inventor: Jacques Peyre, Paris, France

[73] Assignee: SMH Alcatel, Paris, France

[21] Appl. No.: 770,918

[22] Filed: Aug. 30, 1985

[30] Foreign Application Priority Data

Aug. 31, 1984 [FR] France ..... 84 13516

[51] Int. Cl.[4] ..... B65C 11/00

[52] U.S. Cl. ..... 83/203; 83/701; 156/DIG. 33; 156/384

[58] Field of Search ..... 83/203, 701; 156/DIG. 33, 48, 49, 384

[56] References Cited

U.S. PATENT DOCUMENTS

| | | | |
|---|---|---|---|
| 3,193,431 | 7/1965 | Seifert | 156/384 |
| 3,722,340 | 3/1973 | Kobayashi | 83/203 |
| 3,924,498 | 12/1975 | Hill | 83/203 X |
| 3,937,112 | 2/1976 | Geeson | 83/203 X |
| 4,483,733 | 11/1984 | Sato et al. | 156/DIG. 33 |

FOREIGN PATENT DOCUMENTS 2366174 4/1978 France .

*Primary Examiner*—Donald R. Schran

*Attorney, Agent, or Firm*—Sughrue, Mion, Zinn, Macpeak & Seas

[57] ABSTRACT

A machine for producing labels from tape is equipped with tape guide means defining a tape path between an entry point and exit point on the machine and tape drive means comprising at least a first roller, a first shaft on which the first roller is mounted and manual means for rotating the first shaft. A device for loading and positioning the tape in this machine comprises a control arm incorporating a finger having an end adapted to constitute an obstacle on the tape path. It is selectively retractable by the end of the tape when the tape is driven along the tape path. This finger thus constitutes a control lever for the control arm. The device also comprises a claw having an end adapted to immobilize the first shaft when the finger is retracted.

7 Claims, 4 Drawing Figures

TAPE LOADING AND POSITIONING DEVICE

REFERENCE TO RELATED INVENTIONS

This invention relates to the loading and positioning of tapes as set forth in copending applications Ser. Nos. 770,916 and 770,919 filed Aug. 30, 1985, and assigned to the common assignee.

BACKGROUND OF THE INVENTION

1. Field of the Invention

The present invention relates to the loading and positioning of tapes, in particular in automatic dispensers for labels produced from a tape.

2. Description of the Prior Art

In automatic label dispensers for postal franking machines or systems it is known to produce the franking labels from a continuous tape driven intermittently and cut as and when necessary to produce successive labels of the required length.

An object of the present invention is to provide for easy and rapid loading of said tape while simultaneously positioning it as appropriate.

SUMMARY OF THE INVENTION

The present invention consists in a device for loading and positioning a tape in a machine equipped with tape guide means defining a tape path between an entry point and an exit point on the machine and tape drive means comprising at least a first roller, a first shaft on which said first roller is mounted and manual means for rotating said first shaft, said device comprising a control arm incorporating a finger having an end adapted to constitute an obstacle on said tape path selectively retractable by the end of said tape when driven along said path, whereby said finger constitutes a control lever for said control arm, and a claw having an end adapted to immobilize said first shaft when said finger is retracted.

In accordance with one specific feature of the invention the device further comprises insertion means adapted to insert said end of said finger into said tape path in the absence of any tape and said arm is retained elastically on said machine by said insertion means.

In accordance with another specific feature of the invention, said manual means for rotating said first shaft comprise a knob consisting of two parts with substantially the same outside diameter each featuring a notched peripheral ring on one side for fitting them one after the other along the end of said shaft, the part disposed inboard of said first shaft being fastened to it and, the part disposed more outboard on said first shaft being freely rotatable on said first shaft and the device further comprising means for applying said more outboard part elastically against the more inboard part, which drives said shaft or is immobilized by said claw.

Other objects and advantages will appear from the following description of an example of the invention when considered in connection with the accompanying drawings, and the novel features will be particularly pointed out in the appended claims.

DESCRIPTION OF THE PREFERRED EMBODIMENT

Figure 1:
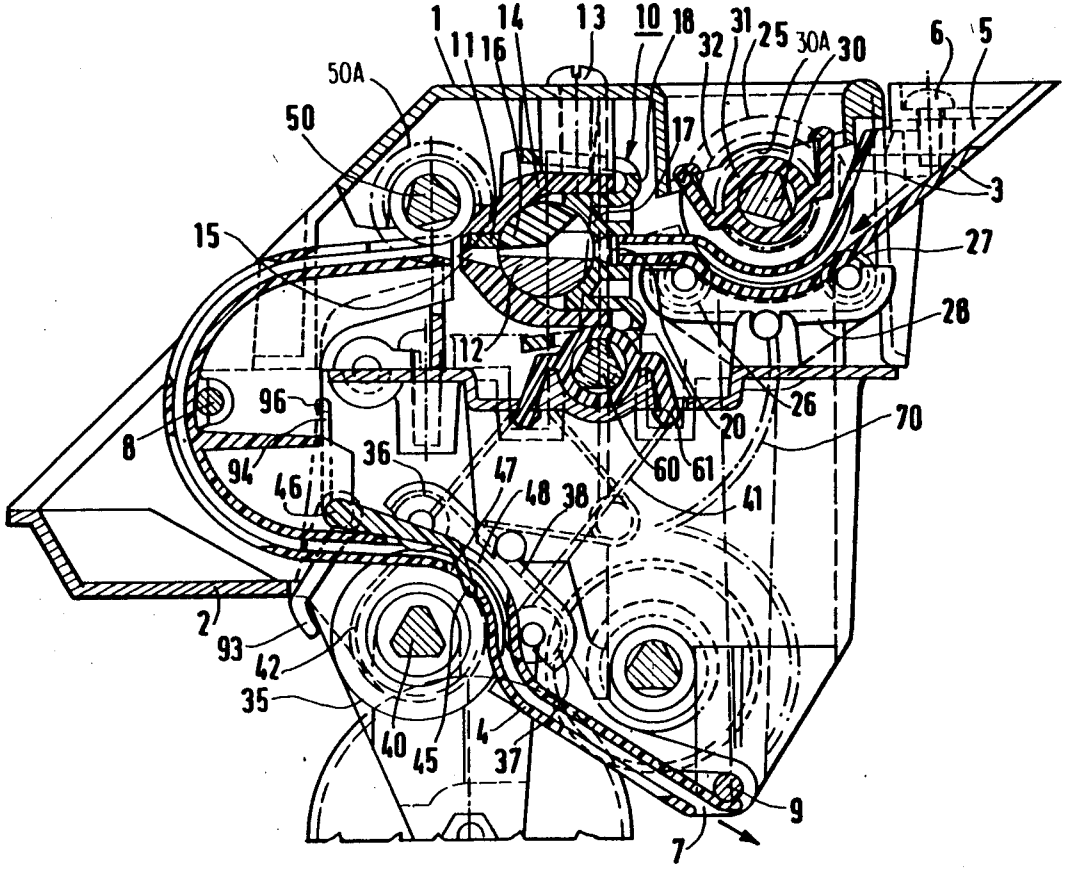
FIG. 1 shows in cross-section a machine for dispensing labels produced from a tape equipped with a tape loading and positioning device in accordance with the invention.

FIG. 1 shows a machine for dispensing labels produced from a tape, or label dispenser, by means of the part thereof which defines the path of movement of the tape within the frame of the machine formed by two half-shells 1 and 2 fastened together.

FIG. 1 shows that the tape feed path is defined by two rigid chutes 3 and 4. The chute 3 defines, on the upper half-shell 1 of the frame, a tape inlet 5, being fixed to the half-shell 1 at the level of this inlet 5 by screws 6. The chute 4 defines on the lower half-shell 2 of the frame a label outlet 7, retaining pins 8 and 9 engaged in fastening lugs provided on this chute and on this half-shell fixing it to the half-shell 2. The two chutes 3 and 4 are curved so as to occupy in the dispenser substantially the same height and width as the frame.

The other two ends of the chutes 3 and 4 are linked within the frame by a cutter 10 with fixed blade 11 and mobile blade 12 disposed between them. This cutter 10 is secured by screws 13 to the upper half-shell 1 of the frame. Its fixed blade 11 is mounted on a support 14 which is U-shaped in cross-section, its semi-circular bottom featuring an opening 15 under the fixed blade 11 for the tape to pass through. Its mobile blade 12 is of semi-circular cross-section; it is fixed to the ends of a support 16, leaving a gap between it and its support over the length of the opening 15. This blade 12 and its support 16 form an assembly pivotally mounted in the support 14 and an auxiliary support 17 with fastening lugs 18 which engage snap-fastener fashion over outwardly projecting pegs on the sides of the U-shaped support 14.

This support 17 also features an opening 20 in line with the opening 15 for the tape to pass through.

Drive means feed the tape and the labels along this feed path. These means comprise, on the part of the path defined by the chute 3, a roller 25 on one side of this chute and two pressure rollers 26 and 27 on the other side of the chute, this roller and these pressure rollers intercepting the tape path through appropriate openings (not shown) in the walls of the chute, in order to feed the tape.

The roller 25 is constrained to rotate with a transmission shaft 30 fixed by bearings 31 forming fastening rings to the upper half-shell 1 of the frame. The two pressure rollers 26 and 27 are feely rotatable on a support cradle 28 secured elastically to the lower half-shell 2 in order to apply them against the roller 25.

The drive means further comprise, on the part of the tape path defined by the chute 4, a roller 35 and two associated pressure rollers 36 and 37 disposed on respective sides of the chute and cooperating through appropriate openings (not shown) in the chute to feed labels cut from the tape. The roller 35 and the pressure rollers 36 and 37 are mounted in an analogous manner to the preceeding assembly. The roller 35 is constrained to rotate with a transmission shaft 40 which carries it, fixed by bearings (not shown) forming fastening rings to the lower half-shell 2 of the frame. The two pressure rollers 36 and 37 are freely rotatable on a support 38 secured elastically to the lower half-shell in order to apply them against the roller 35.

The two shafts 30 and 40 carrying the rollers 25 and 35 which feed the tape and the labels are coupled to one another. The coupling means are shown in dashed line in FIG. 1 as in the dispenser they lie in front of the cross-section plane of this figure. They comprise a notched belt 41 running between a notched pulley wheel 42 at the end of the shaft 40 and another notched pulley wheel 32 at the end of the shaft 30, for transmitting motion from one shaft to the other.

In line with the roller 35 the feed path defined the chute 4 is blocked by the curved end of a finger 45 which retracts when pressed on by the end of the tape. The finger 45 is mounted parallel to the chute on an arm 46. In the absence of tape the curved end of this finger passes through aligned openings 47 and 48 provided in the walls of the chute 4, forming a retractable obstacle on the tape path. The length of the feed path between the cutter 10 and the end of this finger 45 is equal to a first selected label length.

A shaft 50 mounted on the upper half-shell in the immediate vicinity of the cutter 10 by bearings or fastening rings (not shown) operates the cutter 10.

This shaft 50 extends parallel to the mobile blade 12 of the cutter 10. The cutter 10 is operated from the shaft 50 by a coupling between one end of the shaft 50 and one end of the blade 12, or its support 16, of the crank and crankshaft type (not shown) known per se.

The shaft 50 operating the cutter 10 and the shaft 30 driving the roller 25, and therefore the shaft 40 driving the roller 35 by virtue of the coupling of these shafts by the notched belt 41 running between their pulley wheels 32 and 42, are driven from a central shaft 60 secured by bearings or fastening rings 61 to the lower half-shell 2, featuring appropriate intermediate flanges for this purpose. To drive the shaft 50 operating the cutter and the shaft 30 driving the roller from the shaft 60 there are schematically represented mechanisms coupling these shafts at 70 on the shaft 60, at 30A on the shaft 30 and at 50A on the shaft 50. These coupling mechanisms may for example be those covered by French patent application. No. 84 13517 dated Aug. 31, 1984. They feed the tape to secure a required length of label and then, when the tape stops, operate the cutter.

In the tape feed mechanism mounted on the shafts 30 and 40 coupled by the belt 41, the part carried by the shaft 40 also loads the tape manually into the device and cooperates with the control mechanism mounted on the arm 46 for positioning the tape.

Figure 2:
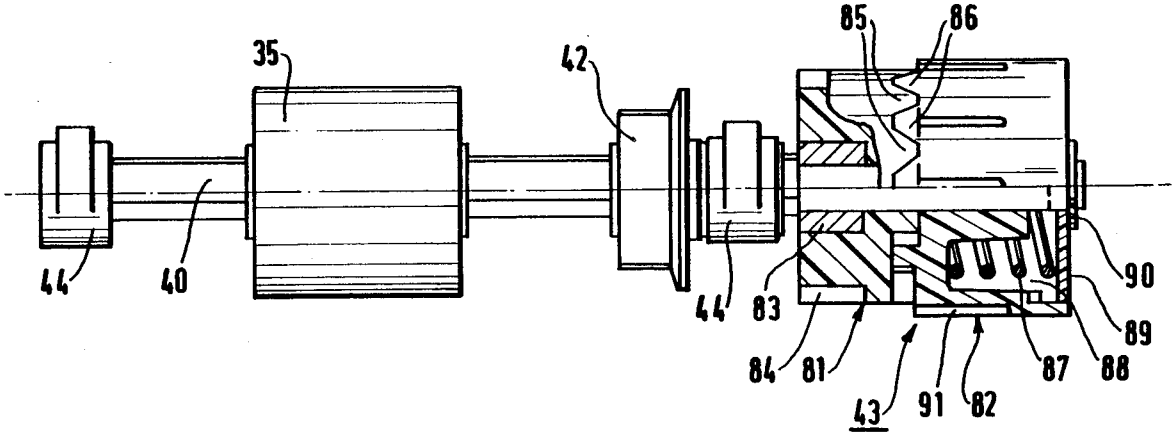
FIG. 2 is a front view of the mechanism for feeding the tape into the dispenser manually.
Figure 3:
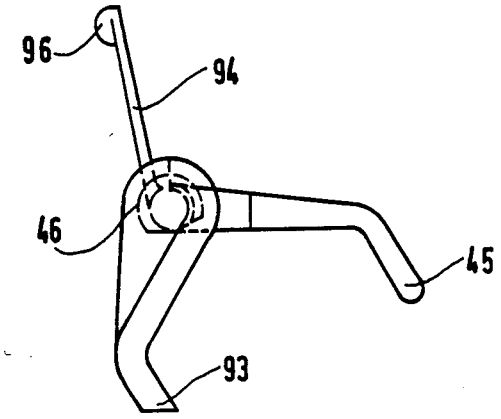
FIGS. 3 and 4 are respectively side and front views of the control mechanism associated with the mechanism for feeding the tape manually into the dispenser, together constituting the tape loading and positioning device in accordance with the invention.
Figure 4:
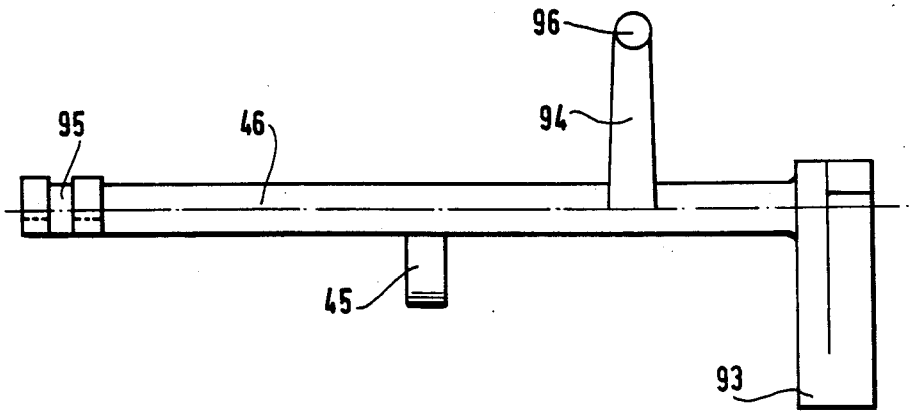

There are shown separately in FIG. 2 the equipment mounted on the shaft 40 for manually loading the tape and in FIGS. 3 and 4 the associated control mechanism mounted on the arm 46.

The shaft 40 carries the roller 35 and the notched pulley wheel 42 coupled by the aforementioned belt to the shaft 30 (FIG. 1).

It also carries two bearings or fastening rings 44 and, at one end outside the frame, a manual operation knob 43. This knob 43 is formed in two parts 81 and 82 having substantially the same outside diameter, these two parts are fitted one after the other and mounted along the end of the shaft 40. The part 81, that more inboard on the shaft 40, drives the shaft to which it is fastened by a bearing 83. It features a peripheral toothed portion 84 which cooperates with the mechanism carried by the arm 46, as will be described hereinafter.

It features on one side, for locking it to the part 82, a notched peripheral ring 85. The end part 82 features on one side a corresponding notched peripheral ring 86 which interlocks with the ring 85. This part 82 is maintained elastically interlocked with the part 81 by a spring 87. This spring 87 is trapped between the bottom of a recess 88 defined in the end surface of the part 82 and a washer 89 closing the recess and secured to the shaft 41 by a circlip 90. This part 82 is freely rotatable on the shaft 40. It is coupled to the shaft 40 via the part 81. Ribs 91 on the periphery of the part 82 facilitate the manual operation of the resulting knob 43 alike a knurled knob for driving the shaft 40.

The control mechanism mounted on the arm 46 comprises the aforementioned finger 45, which constitutes a control lever, an end claw 93 and an intermediate elastic return lever 94.

At the end opposite the claw 93 it features a groove 95 by which it is secured to fastening lugs (not shown) provided on the chute 4 and the frame (FIG. 1).

From FIGS. 1 through 3 it is seen that the component parts of the control mechanism mounted on the arm 46 are disposed in corresponding relationship with those of the feed mechanism mounted on the shaft 40. The arm 46 extends parallel to the shaft 40, the finger 45 and the claw 93 being disposed substantially symmetrically relative to the plane passing through the median axes of the arm 46 and the shaft 40, having their ends curving towards one another. The claw 93 is positioned facing the toothed annular portion 84 of the part 81 of the knob 43. The finger 45 is positioned in front of the roller 35, being slightly offset from the surface of the roller so that it is inserted into the chute 4 at a given distance from the cutter equal to a defined label length. The elastic return lever 94, formed by a thin tang, has a semi-cylindrical pin 96 at its end, this pin bearing on the dispenser frame. The lever inserts the end of the obstacle finger into the chute 4 in the absence of tape in the chute.

The tape loading and positioning device operates in the following manner.

The end of the tape (not shown) inserted into the dispenser inlet 5 as far as the roller 25 is guided along the chute 3 and into the chute 4 by the roller 25 driven through the coupling by the belt 41 between the shaft 30 and the shaft 40 on manual rotation of the knob 43.

Abutment of the end of the tape against the end of the finger 45 retracts it to offer unimpeded passage through the chute 4. This retraction of the finger 45 is simultaneously transmitted to the arm 46 and causes an inverse rocking movement of the end of the claw 93 which engages in the toothed portion on the annular portion 84 of the part 81 of the knob 43 to immobilize this part 81 and thus to prevent the shaft 40 rotating.

Under these conditions, continued manual operation of the knob 43, through the more accessible end part 82, is no longer transmitted to the shaft 40. The elastic connection between the two parts 81 and 82 of the knob causes the notched ring 86 on the part 82 still being operated to jump over the notched ring 85 on the part 81 which is immobilized at this time. The continuation of this manual actuation once the finger is retracted, with the end of the tape lying over the retracted finger, continues to have no effect with regard to feeding of the tape, which is at this time considered loaded and positioned appropriately in the machine ready to function for the production of labels from the tape.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. Device for loading and positioning a tape in a machine equipped with a tape guide means defining a tape path between an entry point and an exit point on the machine and tape drive means, said tape drive means comprising; at least a first roller, a first shaft, said first roller being mounted on said first shaft, manual means for rotating said first shaft, said device comprising; a control arm incorporating a finger, said finger having an end constituting an obstacle on said tape path, means for rotatably mounting said control arm with respect to said tape path such that said finger end is selectively retractable by the end of the tape when driven along said path, whereby said finger constitutes a control lever for said control arm, and said control arm further including a claw having an end immobilizing said first shaft when said finger is retracted.

2. Device according to claim 1, further comprising insertion means for inserting said end of said finger into said tape path in the absence of any tape and means for retaining said arm elastically on said machine by said insertion means.

3. Device according to claim 2, wherein said machine includes a frame, said insertion means for retaining elastically said arm comprise a tang on said arm having an end bearing on said frame of said machine to form a return lever.

4. Device according to claim 1, wherein said arm is substantially parallel to said first shaft and said finger and said claw are disposed substantially symmetrically to the plane passing through the axes of said arm and said first shaft.

5. Device according to claim 1, wherein said manual means for rotating said first shaft comprise a knob at the end of said first shaft having at its periphery an annular toothed portion facing the end of said claw.

6. Device according to claim 5, wherein said knob comprises two parts with substantially the same outside diameter each featuring a notched peripheral ring on one side for locking them together, one part being disposed more inboard on said first shaft and carrying said annular toothed portion and driving said first shaft and one part being disposed more outboard on said first shaft and being freely rotatable on said first shaft, and said device further comprising means for applying said more outboard part elastically against said more inboard part.

7. Device according to claim 1, for an automatic label dispensing machine, further comprising a second roller, a second shaft on which said second roller is mounted, a drive shaft driving said second shaft so that said tape is driven intermittently by said second roller, and a cutter operable when said second roller is stopped, and wherein said finger is disposed so that said end thereof constituting said retractable obstacle is on the upstream side of said cutter at a distance therefrom along said tape path equal to a first defined ticket length.

* * * * *